United States Patent [19]

Speer

[11] Patent Number: 4,826,049

[45] Date of Patent: May 2, 1989

[54] CORDLESS ADHESIVE DISPENSING SYSTEM

[75] Inventor: Howard D. Speer, Marriottsville, Md.

[73] Assignee: Black & Decker Inc., Newark, Del.

[21] Appl. No.: 82,473

[22] Filed: Aug. 7, 1987

[51] Int. Cl.[4] ..... H05B 3/42

[52] U.S. Cl. ..... 222/146.5; 200/51.09; 219/242; 219/247; 219/259; 222/173; 248/117.2; D8/71

[58] Field of Search ..... 222/173, 146.5, 180; 219/227, 229, 230, 233, 241, 242, 246, 247, 240, 259; 211/70.6; 248/176, 117.1-117.6, 310, 222.2; 439/137, 140, 188, 345, 346, 481, 500; 30/DIG. 1; D8/30, 68, 69, 71; D13/6, 11; D32/31; 310/50; 320/2; 362/183, 190; 200/51.09, 50 B, 51 R, 153 A; 38/79, 88, 96, 142

[56] References Cited

U.S. PATENT DOCUMENTS

| | | | |
|---|---|---|---|
| D. 234,905 | 4/1975 | Foster et al. | D8/71 |
| 1,851,685 | 3/1932 | Salmon | 219/247 X |
| 2,750,696 | 6/1956 | Krammes | 248/117.1 X |
| 2,820,877 | 1/1958 | Oats, Jr. | 219/247 |
| 2,995,159 | 8/1961 | Berggren | 222/146.5 X |
| 3,183,891 | 5/1965 | MacDonald | D13/6 X |
| 3,204,828 | 9/1965 | Paulsen | 222/146.5 |
| 3,277,358 | 10/1966 | Nicholl | D13/6 X |
| 3,359,635 | 12/1967 | Jepson | 30/DIG. 1 X |
| 3,388,885 | 6/1968 | Holmes | 240/310 |
| 3,398,260 | 8/1968 | Martens | 219/247 |
| 3,413,742 | 12/1968 | Le Sueur et al. | 219/242 X |
| 3,523,176 | 8/1970 | Hill | 219/259 X |
| 3,728,664 | 4/1973 | Hurst | 320/2 X |
| 3,745,676 | 7/1973 | Dikoff | 38/96 |
| 3,760,149 | 9/1973 | Harsanyi | 219/247 |
| 3,924,097 | 12/1975 | Knowles et al. | 219/247 X |
| 3,942,856 | 3/1976 | Mindheim et al. | 200/51.09 |
| 4,085,867 | 4/1978 | Heller | 248/222.2 X |
| 4,092,580 | 5/1978 | Prinsze | 320/2 |
| 4,101,756 | 7/1978 | Yamano | 439/481 X |
| 4,225,814 | 9/1980 | Gantz et al. | 320/2 |
| 4,333,623 | 6/1982 | May | 248/117.2 X |
| 4,418,268 | 11/1983 | Munshaw | 248/117.2 X |
| 4,528,429 | 7/1985 | Dobson et al. | 200/51.09 X |
| 4,670,701 | 6/1987 | Sako et al. | D32/31 X |
| 4,692,587 | 9/1987 | Spirk, Jr. et al. | 222/173 X |
| 4,719,334 | 1/1988 | Rebel | 248/117.2 X |
| 4,730,799 | 3/1988 | Foss et al. | 248/117.2 X |

OTHER PUBLICATIONS

Cordless Screwdriver "Wen Products Inc" (advertisment).

Exhibit A-'Thermogrip' Cordless Gluegun by Emhart Home Products (brochure).

*Primary Examiner*—Kevin P. Shaver

*Attorney, Agent, or Firm*—Charles E. Yocum; Dennis A. Dearing; Edward M. Murphy

[57] ABSTRACT

A cordless adhesive dispensing system includes an electrically-heated dispensing gun and cooperating base that supports the gun and effects both a mechanical and electrical connection to the gun. The gun accepts solid adhesive and melts the adhesive in response to an electrical current provided to the gun through a mechanical and electrical interface. The electrical interface includes cooperating electrical contacts on both the gun and the base that effect electrical contact as the gun is mounted to the base by the operator and electrical disconnection as the gun is dismounted. A switch is in-circuit with the contacts and closes the circuit to the gun after the gun is fully mounted to the base and effects electrical interruption as the gun is dismounted. The mechanical interface maintains the mounted gun at a convenient, easy-to-grip attitude and includes pivoted interface surfaces that allow the gun to be pivoted into and out of its mechanical and electrical interfacing with the base in a reliable manner.

23 Claims, 4 Drawing Sheets

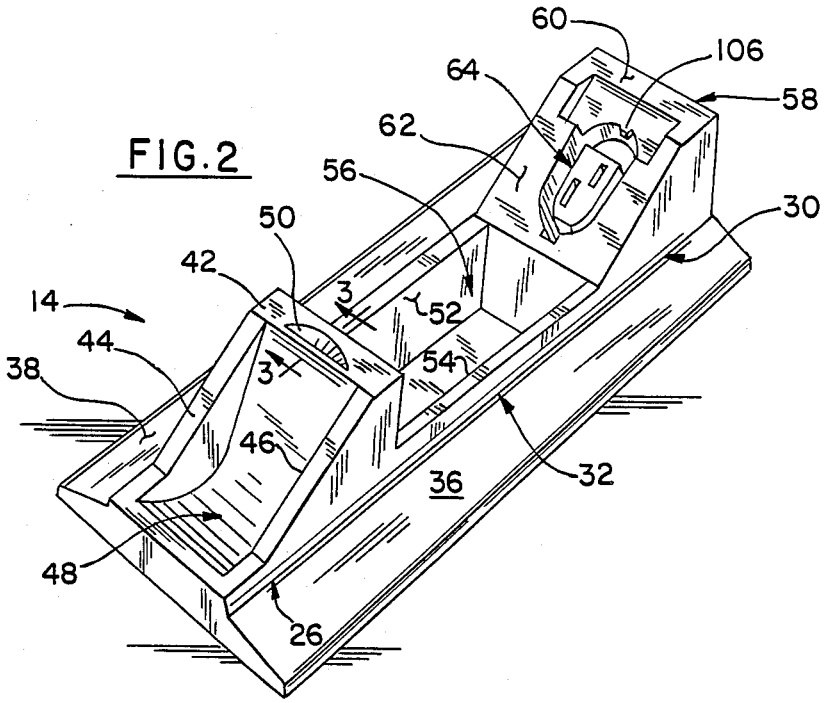
FIG. 2
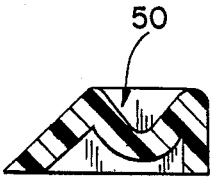
FIG. 3
FIG. 4
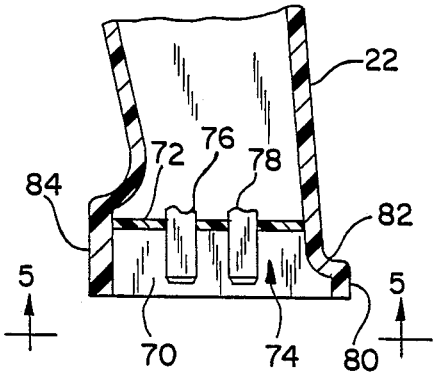
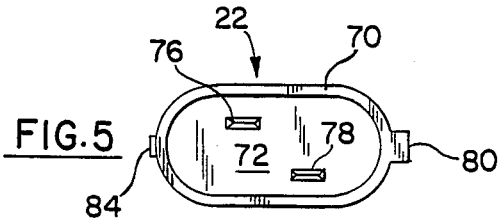
FIG. 5

CORDLESS ADHESIVE DISPENSING SYSTEM

BACKGROUND OF THE INVENTION

The present invention relates to hand-held tools and, more particularly, to cordless, hand-held adhesive dispensers such as thermoplastic adhesive and caulk dispensing guns.

Various types of electrically powered tools are known for dispensing hot-melt glues, adhesives, and caulking materials. These tools are commonly characterized as 'glue guns' and typically have a gun-like shape with a handle that is grasped by the user. The glue gun contains an electric heater element that is powered though an electric cord which typically passes through the handle and is connected to an electric outlet in the usual manner. The material to be dispensed, for example, hot-melt adhesive in stick form, is loaded into the gun through an entry port, melted by the heater, and dispensed through a nozzle. In some glue guns, a trigger is provided to selectively control the velocity of the heated material dispensed through the nozzle. In general, the ability to manually place the nozzle against or adjacent the area onto which the adhesive is to be dispensed can be hindered by the electric power cord. For example, the cord can become entangled or snagged on the work table and thus limit the usefulness of the dispenser. In order to provide greater flexibility in these types of hand-held tools, cordless versions can be fabricated with detachable connectors between the glue gun handle and the power cord. Such a connector arrangement, however, requires a two-handed operation to connect the power cord with the gun to heat the hot-melt adhesive and to periodically disconnect the power cord to allow cordless manipulation of the glue gun. Accordingly, a need exists for a system that allows a glue gun to be conveniently connected and disconnected from a power source to allow convenient cordless hand-held operation.

SUMMARY OF THE INVENTION

In view of the above, it is an object of the present invention, among others, to provide a cordless adhesive dispensing system in which the dispensing gun is maintained in a ready-to-use state on a support base and which can be conveniently detached from the base and used to dispense a heated thermoplastic adhesive-like material.

It is another object of the present invention to provide a hand-held, cordless glue gun in which the gun is conveniently mounted to and dismounted from a support base that also effects efficient electrical connection and disconnection to the glue gun as part of the mounting and dismounting operation.

It is still another object of the present invention to provide a hand-held, cordless glue gun in which the gun is conveniently mounted to and dismounted from a support base that includes provision to receive excess adhesive and store a reserve supply of adhesive for loading into the glue gun.

In view of these objects, and others, the present invention provides a cordless adhesive dispensing system that includes an electrically-heated dispensing gun and cooperating support base that supports the gun and effects both a mechanical and electrical connection to the gun. The gun accepts solid hot-melt materials, such as adhesives and caulks in stick form, and melts the material in response to an electrical current provided to the gun through a mechanical and electrical interface. The electrical interface includes cooperating electrical contacts on both the gun and the base that effect electrical contact as the gun is mounted to the base by the user and electrical disconnection as the gun is dismounted. A switch is provided in-circuit with the electrical contacts and closes the circuit to the gun after the gun is fully mounted to the base and opens the electrical circuit as the gun is dismounted. The mechanical interface maintains the mounted gun at a convenient, easy-to-grip attitude and includes a pivoted interface that allows the gun to be pivoted into and out of its mechanical and electrical engagement with the base in a reliable manner.

The present invention advantageously provides a hand-held, cordless glue gun system in which the gun is conveniently mounted to and dismounted from a support base to provide a convenient dispensing system compared to prior glue guns which are permanently attached to a power source through a line cord.

Other objects and further scope of applicability of the present invention will become apparent from the detailed description to follow, taken in conjunction with the accompanying drawings, in which like parts are designated by like reference characters.

BRIEF DESCRIPTION OF THE DRAWING

FIG. 2 is a perspective view of the base shown in FIG. 1;

FIG. 3 is a detail of the base shown in FIG. 2 taken along line 3—3 of FIG. 2;

FIG. 4 is a partial elevational view, in cross-section, of the handle portion of the exemplary glue gun of FIG. 1;

FIG. 5 is a bottom view of the handle portion of the glue gun of FIG. 4 taken along line 5—5 of FIG. 4;

DESCRIPTION OF THE PREFERRED EMBODIMENT

Figure 1:
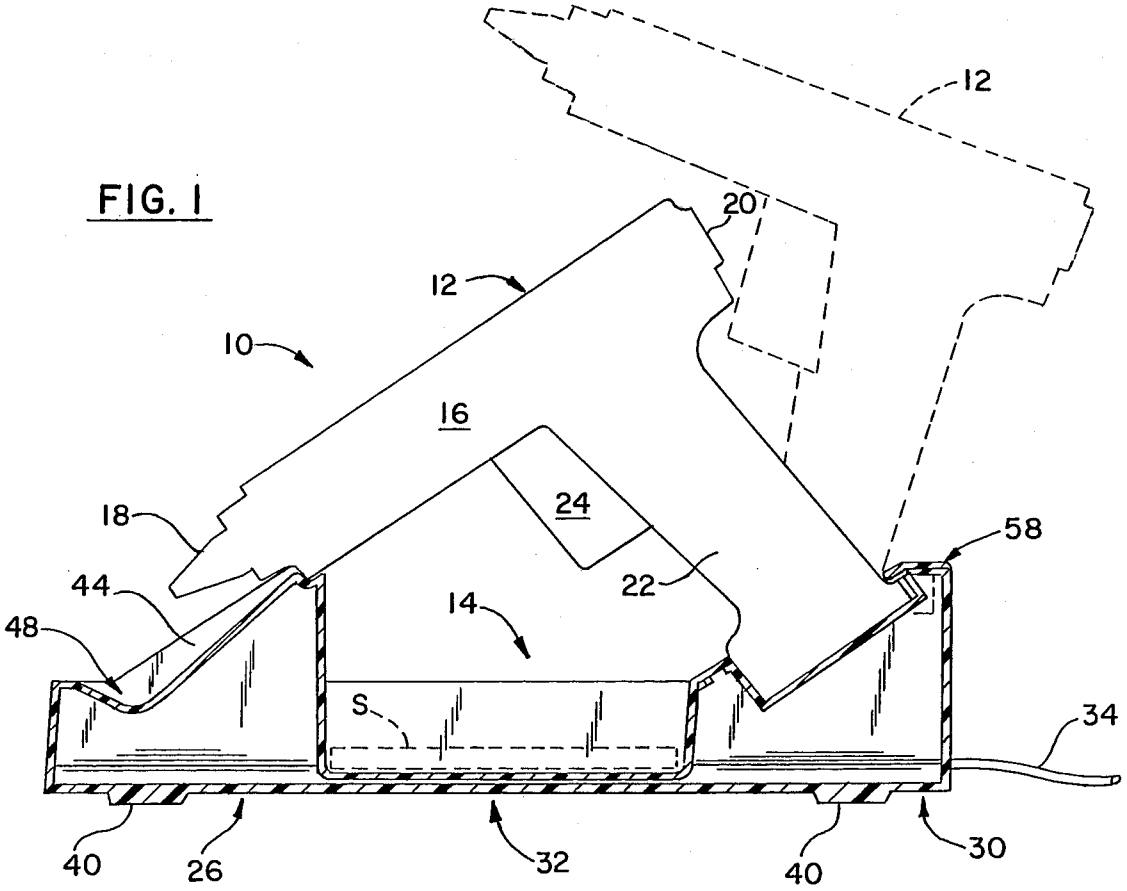
FIG. 1 is a side elevational view of a cordless glue gun system with an exemplary glue gun (solid-line illustration) shown mounted on a base and in an upwardly rotated position (dotted-line illustration)

A preferred embodiment of a cordless adhesive dispensing system in accordance with the present invention is shown in FIG. 1 and designated generally therein by the reference character 10. As shown, the system 10 includes an adhesive dispensing gun, referred to herein as glue gun 12, and a glue gun base 14 to which the glue gun 12 is mounted to and dismounted from by the user. The glue gun 12 includes a body portion 16 and a nozzle 18 at its forward end from which heated, molten material, including various types of adhesives and caulking, is discharged. An entry port 20 is provided at the opposite end of the body 16 and receives pre-formed sticks (not shown) of solid hot-melt material for heating in the glue gun 12 and eventual discharge through the nozzle 18. Typically, the preformed sticks are formed in lengths of two or four inches with a diameter of one-half inch. A handle 22 is attached to the glue gun body 16 and includes a user-operable trigger 24 which is squeezed to discharge the hot, plastic material from the nozzle 18 in the conventional manner. A suitable gun glue 12 modified in accordance with the present invention is the Model 9735 Type 2 gun sold by Black & Decker, Hunt Valley, Md. 21030.

The glue gun base 14, which is shown in cross-section in FIG. 1 and in perspective view in FIG. 2, includes a forward portion 26 (on the left in FIG. 1), a rear portion 30 at the opposite end, and an intermediate portion 32. An electrical power cord 34 (FIG. 1) is connected to the rear portion 30 of the base 14 to supply electrical power to the glue gun 12 as described more fully below in relationship to FIG. 9. The base 14 includes (FIG. 2) laterally outward extending portions 36 and 38 that extend along the length of the base 14. Support pads or feet 40 (FIG. 1) are attached to or formed as part of the underside of the laterally outward extending portions 36 and 38. A pedestal 42 and upstanding sidewalls 44 and 46 are formed at the forward end of the base 14 and define a forwardly facing well 48 for receiving any adhesive material dropped from the nozzle 18 when the glue gun 12 is mounted to the base 14. An indentation 50, shown in detail in FIG. 3, is formed in the upwardly facing surface of the pedestal 42 and engages the forward end of the glue gun 12 when it is mounted on the base 14 as shown in FIG. 1. The intermediate portion 32 of the base 14 includes sidewalls 52 and 54 that define an interior well 56 for storing pre-formed adhesive sticks S (shown in dotted line in FIG. 1) for loading into the glue gun 12 through the entry port 20. The rear portion 30 of the base 14 includes an upstanding pedestal 58 defined by a top surface 60 and a forwardly inclined surface 62. A connection interface, generally indicated at 64 and explained in more detail below, is formed on the inclined surface 62 for mechanically and electrically engaging the handle 22 of the glue gun 12 as shown in FIG. 1.

As shown in FIGS. 4 and 5, the lower portion of the glue gun handle 22 includes a depending skirt 70 that cooperates with an interior partition 72 to define a connection cavity 74. Blade-type electrical contacts 76 and 78 depend from the partition 72 for electrically engaging the connection interface 64 as described below. As shown in FIG. 5, the blade-type contacts 76 and 78 are staggered relative to one another, that is, they are mounted in a non co-planar relationship to prevent direct connection to the end of a conventional electric extension cord. A tab 80 is formed on the rear side of the handle 22 and merges at its upper end with a curved pivot surface 82 that is formed at a preferred radius R. A vertically aligned key 84 is formed on the forwardly facing side of the handle 22 and serves to both assist in aligning the glue gun 12 when it is mounted to the base 14 as well as actuate an electrical switch as described below.

Figure 6:
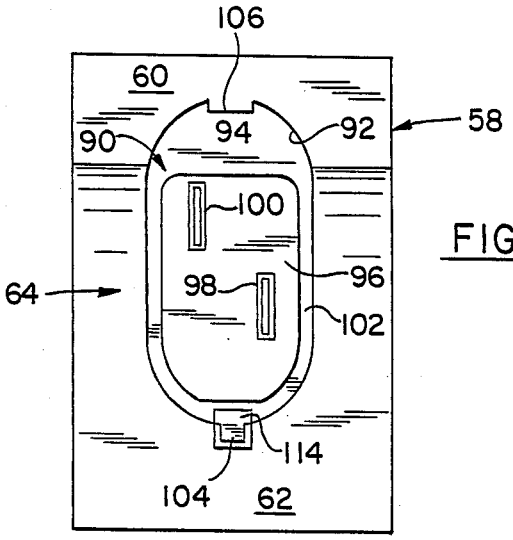
FIG. 6 is a plan view of a connection interface for engaging the exemplary glue gun of FIG. 1.
Figure 7:
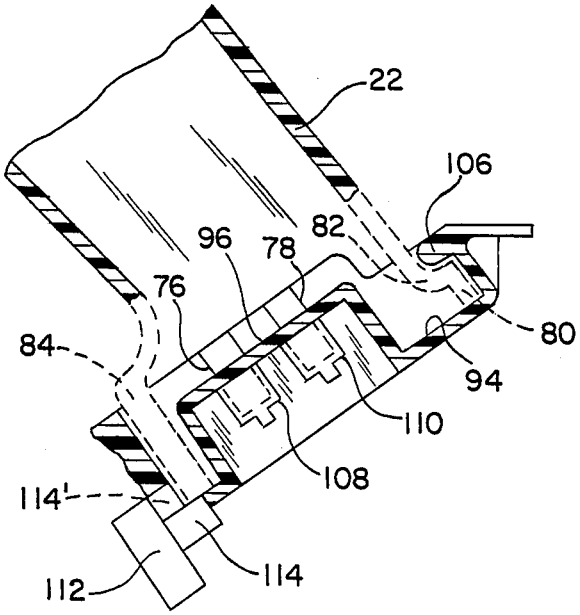
FIG. 7 is a side view, in partial cross-section, of the glue gun handle and its mounting interface.

The connection interface 64 of FIG. 2 is shown in greater detail in FIGS. 6 and 7. As shown, a connection cavity 90 is formed in the forwardly inclined surface 62 of the pedestal 58 (FIG. 2) and is defined by a generally ovoid interior wall 92 and a cooperating interior partition 94. A connector block 96 extends upwardly from the interior partition 94 and includes slot-like openings 98 and 100 for receiving the blade contacts 76 and 78, respectively, of the glue gun 12 (FIGS. 4 and 5). The connector block 96 is dimensioned to define an annular groove 102 with the interior wall 92. The annular groove 102 receives the depending skirt 70 of the handle 22 are shown in broken-line illustration in FIG. 7. A keyway 104 is formed at the forward side of the interior wall 92 for accepting the key 84 on the forward side of the handle 22. A tab 106 extends forwardly from the rear side of the interior wall 92 and, as shown in FIG. 7, overhangs the wall 92 and is spaced from the interior partition 94 by a distance at least coextensive with the length of the tab 80 extending from the rear side of the handle 22. The forward end of the tab 106 is formed at a radius substantially the same as the radius R of the pivot surface 82 formed on the handle 22 above the tab 80. Electrical receptacle contacts 108 and 110 are mounted in the connector block 96 and are designed to receive and effect electrical contact with the blade contacts 76 and 78, respectively, as they pass through the slots 98 and 100. The slots 98 and 100, as well as their electrical contacts 100 and 110, are positioned in a staggered relationship complementary with that of the blade contacts 76 and 78 of the handle 22. The staggered relationship prevents the connection interface 64 from functioning as an extension outlet for conventional electrical appliance plugs. A normally OFF, spring-based, single-pole switch 112 (FIG. 7) forms part of the connection interface 64 and includes an actuatable member 114 that is normally biased by an internal spring (not shown) to a first position 114' and extends into the lower portion of the keyway 104. The member 114 is forced to a second, ON position (as indicated in solid-line illustration in FIG. 7) by the key 84 as the handle 22 is inserted into the interface 64.

Figure 8:
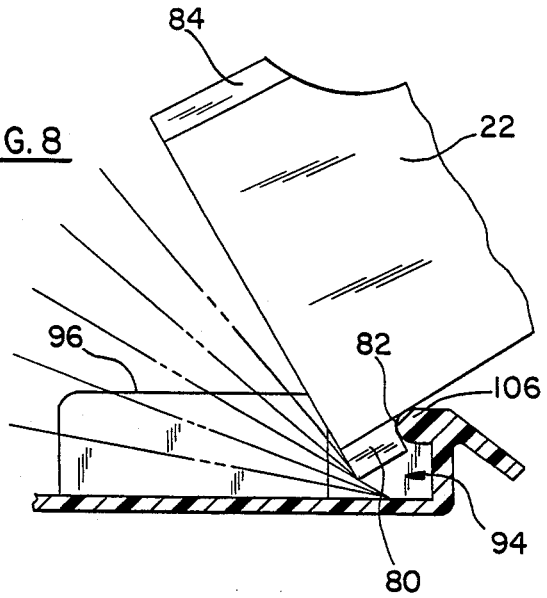
FIG. 8 is a view of the glue gun handle and mounting interface of FIG. 7 in various positions as the handle is rotated relative the interface.
Figure 9:
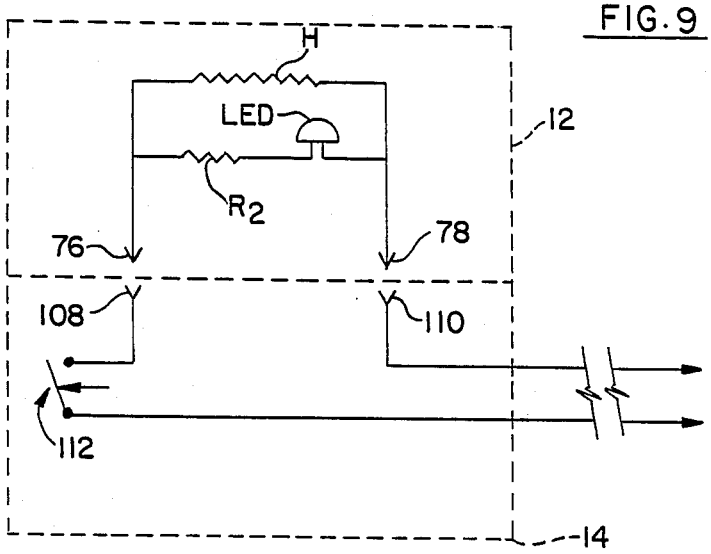
FIG. 9 is a schematic diagram of the electrical circuit for the connected glue gun and base.

The connection interface 64 functions to allow the user to effect mechanical and electrical engagement and disengagement of the glue gun 12 with its base 14 with a convenient pivoting motion. As shown in FIG. 8, the handle 22 of the glue gun 12 is engaged with the connection interface 64 by first inserting the tab 80 of the handle 22 into the cavity 94 and beneath the overhanging tab 106 with the pivot surface 82 of the handle 22 contacting the similarly radiused surface at the end of the tab 106. With the parts in this relationship, the glue gun 12 is rotated counterclockwise in FIG. 8 with the pivot surface 82 sliding relative to the radiused tab 106 to allow the skirt 70 to enter the annular groove 102 of the connection interface 64 with the key 84 entering the keyway 104. As the glue gun 12 is pivoted into its mounted position, the blade contacts 76 and 78 effect connection with their respective receptacle contacts 108 and 110, and the key 84 contacts the member 114 of the normally OFF switch 112 and pushes the member 114 downwardly to its second, ON position to close an electrical circuit to provide power to the glue gun 12. An exemplary electrical circuit for the system 10 is shown in FIG. 9 and, as shown, a heater element H is mounted in the glue gun 12 and is connected in parallel circuit with a series-connected light-emitting diode LED and current-limiting resistor $R_1$ with electrical connection to the base 14 made through the contact pairs 76/108 and 78/110. When the switch 112 is closed, electrical current flows through the heater H to heat the thermoplastic adhesive with the light emitting diode LED also illuminated to indicate current flow to the user. The light emitting diode LED can be mounted at any location of the glue gun 12, although a rearward position on the handle 22 is preferred.

In normal operation, the glue gun 12 is mounted to the base 14 with the heater H operative to melt the thermoplastic material in the gun. In order to apply the heated material, the user grasps the handle 22 and pivots the glue gun 12 clockwise in FIG. 1 to the dotted-line position to interrupt the flow of electricity by allowing the switch 112 to move to its normally open position, to disconnected the electrical contact pairs 76/108 and 78/110, and to cause the tab 80 on the handle 22 to clear the tab 106 and thus allow the user to lift the glue gun 12 from the base 14 for use. The heated components of the glue gun 12, principally the heater H and the reserve of molten thermoplastic material, have sufficient heat capacity to provide enough heated material for the range of expected applications. After the heated material is applied, the glue gun 12 is returned to the base 14 in the manner described above.

The present invention advantageously provides a hand-held, cordless glue gun system in which the gun is conveniently mounted to and dismounted from a support base to provide a convenient dispensing system compared to prior glue guns which are permanently attached to a power source through a line cord.

Thus it will be appreciated from the above that as a result of the present invention, a cordless adhesive dispensing system is provided by which the principal objectives, among others, are completely fulfilled. It will be equally apparent and is contemplated that modification and/or changes be made in the illustrated embodiment without departure from the invention. Accordingly, it is expressly intended that the foregoing description and accompanying drawings are illustrative of preferred embodiments only, not limiting, and that the true spirit and scope of the present invention will be determined by reference to the appended claims and their legal equivalent.

What is claimed is:

1. A cordless thermoplastic dispensing system, comprising:

a hot-melt dispensing gun having a body portion containing an electrical heater, a nozzle for dispensing heated thermoplastic material, and an entry port for accepting a supply of thermoplastic material for heating by said heater and dispensing from said nozzle;

a base member upon which said dispensing gun is mounted and dismounted, said base member comprising front and rear portions and a cavity portion connected therebetween for receiving a supply of thermoplastic material; and means for mechanically and electrically interfacing said dispensing gun to said base means during mounting and dismounting of said dispensing gun from said base.

2. The system of claim 1, wherein:

said front and rear portions are defined, respectively, by front and rear upstanding pedestals.

3. The system of claim 2, wherein:

said front pedestal includes a well for accumulating thermoplastic matrial exiting from said nozzle of said dispensing gun.

4. The system of claim 2, wherein:

said interface means is positioned atop said rear pedestal.

5. A cordless thermoplastic dispensing system, comprising:

a hot-melt dispensing gun having a body portion containing an electrical heater, a nozzle for dispensing heated thermoplastic material, a handle portion for manual manipulation of said dispensing gun by an operator, and an entry port for accepting a supply of thermoplastic material for heating by said heater and dispensing from said nozzle;

means defining a base upon which said dispensing gun is mountable and dismountable; and means for mechanically and electrically interfacing said handle portion to said base means during mounting, said interface means including a first tab on said handle portion and a second tab on said base, said first and second tabs interengaging with one another to control said dispensing gun to pivot about said first and second interengaged tabs during mounting and dismounting of said handle portion from said base.

6. The system of claim 5, wherein:

each of said first and second tabs have a respective curvilinear surface for mutual interengagement during mounting and dismounting of said disengaging gun.

7. The system of claim 6, wherein:

the radius of each respective curvilinear surface for said first and second tabs is substantially equal.

8. The system of claim 5, wherein said interface means further comprises:

switching means for closing an electrical supply circuit when said dispensing gun is mounted to said base means and for opening the supply circuit when said dispensing gun is dismounted from said base means.

9. The system of claim 8, wherein said interface means further comprises:

a key mounted on said handle for actuating said switching means for closing an electrical supply circuit when said dispensing gun is mounted to said base.

10. The system of claim 9, wherein said switching means is normally biased to an open position for opening an electrical supply circuit when said dispensing gun is dismounted from said base.

11. A cordless thermoplastic dispensing system, comprising:

a hot-melt dispensing gun having a body portion containing an electrical heater, a nozzle for dispensing heated thermoplastic material, a handle portion for manually manipulating said dispensing gun, and an entry port for accepting a supply of thermoplastic material for heating by said heater and dispensing from said nozzle;

means defining a base upon which said dispensing gun is mountable and dismountable; and means for mechanically and electrically interfacing said dispensing gun to said base means and including at least two electrical contacts of a first type on said handle portion for engaging complementary electrical contacts of a second type on said base, said interface means including switching means in circuit with said contacts of the second type for closing an electrical supply circuit when said dispensing gun is mounted to said base means and including a first tab on said handle portion and a second tab on said base, said first and second tabs interengaging with one another to control said dispensing gun to pivot about said first and second interengaged tabs during mounting of said handle portion to said base to cause said electrical contacts of the first and second type to engage respective ones of the other.

12. The system of claim 11, wherein:

said complementary first type and second type electrical contacts are mounted in a staggered relationship to one another.

13. The system of claim 11, wherein said switching means is normally biased to an open position and opens when said dispensing gun is dismounted from said base means.

14. The system of claim 13, wherein:

said electrical energy supply circuit includes light emitting means that is illuminated when said switching means is closed.

15. The system of claim 11, wherein:

each of said first and second tabs having a respective curvilinear surface for mutual interengagement during mounting and dismounting of said dispensing gun.

16. The system of claim 15, wherein:

the radius of each respective curvilinear surface for said first and second tabs is substantially equal.

17. The system of claim 16, wherein said interface means further comprises:

a third tab mounted on said handle for actuating said switching means for closing said electrical supply circuit when said dispensing gun is mounted to said base.

18. A cordless thermoplastic dispensing system, comprising:

a thermoplastic dispensing gun having a body portion including forward and rearward portions and adapted to receive, heat, and dispense thermoplastic material and a handle portion for manual manipulation of said gun;

a base member for supporting said gun during non-use, said base member including front and rear pedestal portions including an intermediate cavity portion connected therebetween, said cavity portion for receiving and storing a supply of thermoplastic material, said front pedestal portion adapted to receive a forward end of said dispensing gun, said rear pedestal adapted to receive said handle portion; and interface means for mechanically and electrically connecting said handle portion to said rear pedestal portion.

19. A system as claimed in claim 18, wherein:

said front pedestal further includes a frontwardly positioned well for accumulating excess thermoplastic material exiting from said forward portion of said dispensing gun.

20. The system of claim 18, wherein:

said front and rear pedestal portions are wedge-shaped.

21. The system of claim 18, wherein:

said interface means for mechanically and electrically connecting said handle portion to said rear pedestal portion includes switching means for closing an electrical energy supply circuit when said dispensing gun is mounted to said rear pedestal portion.

22. The system of claim 21, wherein:

said interface means includes a first tab on said handle portion and a second tab on said rear pedestal portion, said first and second tabs interengaging one another to control the connection and disconnection of said handle portion from said rear pedestal portion so that said dispensing gun pivots about said tabs.

23. The system of claim 22, wherein:

said electrical energy supply circuit includes light emitting means.

* * * * *